US005693247A

United States Patent [19]

Bu et al.

[11] Patent Number: 5,693,247

[45] Date of Patent: Dec. 2, 1997

[54] MICROWAVE OVEN WITH MULTI-INFRARED SENSORS DISPOSED AT DIFFERENT DISTANCE INTERVALS FROM THE ROTATING TABLE PLANE

[75] Inventors: Jong Uk Bu; Kwang Gyun Jung, both of Seoul, Rep. of Korea

[73] Assignee: LG Electronics Inc., Seoul, Rep. of Korea

[21] Appl. No.: 488,930

[22] Filed: Jun. 9, 1995

[30] Foreign Application Priority Data

Jun. 11, 1994 [KR] Rep. of Korea ..... 94-13192

[51] Int. Cl.[6] ..... H05B 6/68; H05B 6/78

[52] U.S. Cl. ..... 219/711; 219/754; 374/149; 99/325

[58] Field of Search ..... 219/711, 710, 219/510, 754; 374/149, 121, 126, 129, 130, 131, 133; 99/325

[56] References Cited

U.S. PATENT DOCUMENTS

| | | | |
|---|---|---|---|
| 4,734,553 | 3/1988 | Noda | 219/711 |
| 5,180,896 | 1/1993 | Gibby et al. | 219/711 |

FOREIGN PATENT DOCUMENTS

| | | | |
|---|---|---|---|
| 57-52724 | 3/1982 | Japan | 219/711 |
| 57-84931 | 5/1982 | Japan | 219/711 |
| 61-250422 | 11/1986 | Japan | 219/711 |
| 1-147224 | 6/1989 | Japan | 219/711 |

*Primary Examiner*—Philip H. Leung
*Attorney, Agent, or Firm*—John P. White

[57] ABSTRACT

A microwave oven includes at least two sensors for detecting heat rays emitted from the food which is being heated, a signal processor for obtaining a precise surface temperature of food, irrespective of the deviation of distances between the sensors and food, using output signals from the sensors, and a controller for receiving the output signal of the signal processor to recognize the cooking status of the food and controlling the heating of the food in accordance with the recognized cooking status.

6 Claims, 2 Drawing Sheets

MICROWAVE OVEN WITH MULTI-INFRARED SENSORS DISPOSED AT DIFFERENT DISTANCE INTERVALS FROM THE ROTATING TABLE PLANE

BACKGROUND OF THE INVENTION

The present invention relates to a microwave oven, and more particularly, to a microwave oven which is suitable to execute a precise cooking control by detecting the radiant temperature of the food surface by a remote sensor and compensating the distance between the food and sensor.

A conventional microwave oven detects the cooking status by using a temperature detecting sensor, wetness detecting sensor, vapor detecting sensor or weight detecting sensor, and executes an automatic cooking therethrough. For example, in order to detect the amount of food, the weight of the food is measured and then the cooking completion point of time is determined. Otherwise, cooking is executed such that the temperature, wetness or gas of a point of time is detected to calculate the remaining cooking time.

However, the conventional microwave oven has a limit since the cooking is executed by measuring the changes in the wetness, gas, vapor or ambient temperature of the food. Particularly, in the case of a defrosting, when the defrosting time is determined by detecting the weight, errors due to the quality or size of a vessel or eccentric error due to the position of the vessel are generated, which may cause a malfunction of the microwave oven. Also, during a general defrosting mode, in order to prevent a refrigerated meat being cooked a magnetron is turned on and off with a sufficient time interval. However, such a mode requires too much time for the defrosting completion.

Meanwhile, in order to execute a cooking by detecting an optimum cooking status, as one of cooking methods by a radiant temperature detection of a food, a detection method using an infrared sensor and cooking control using the same have been applied for a patent in Korea in the application Nos. 94-5483 and 94-5485. In these cases, since the output signals are different depending on the distance between the sensor and food, it is difficult to detect and control the cooking status precisely.

SUMMARY OF THE INVENTION

Therefore, it is an object of the present invention to provide a microwave oven for detecting the temperature of the surface of food precisely by operating output signals of at least two sensors disposed at a constant distance with each other and compensating the distance between food and sensors from the output signals of the sensors using the answer of a second degree equation.

It is another object of the present invention to provide a microwave oven for controlling the oscillating mode of a magnetron by receiving signals output from at least two sensors in accordance with a predetermined period of time and calculating the radiant temperature of the surface of food to then be compared with a reference value.

It is still another object of the present invention to provide a microwave oven for controlling a magnetron for an optimum cooking in the case of completed cooking below the boiling point of water, such as defrosting or warming which is hard to be detected, using information on the temperature of food surface obtained by means of sensors.

To accomplish the above objects, the microwave oven according to the present invention comprises:

at least two sensors for detecting heat rays emitted from the food which is being heated;

a signal processor for obtaining a precise surface temperature of food, irrespective of the deviation of distances between the sensors and food, using output signals from the sensors; and a controller for receiving the output signal of the signal processor to recognize the cooking status of the food and controlling the heating of the food in accordance with the recognized cooking status.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 2:
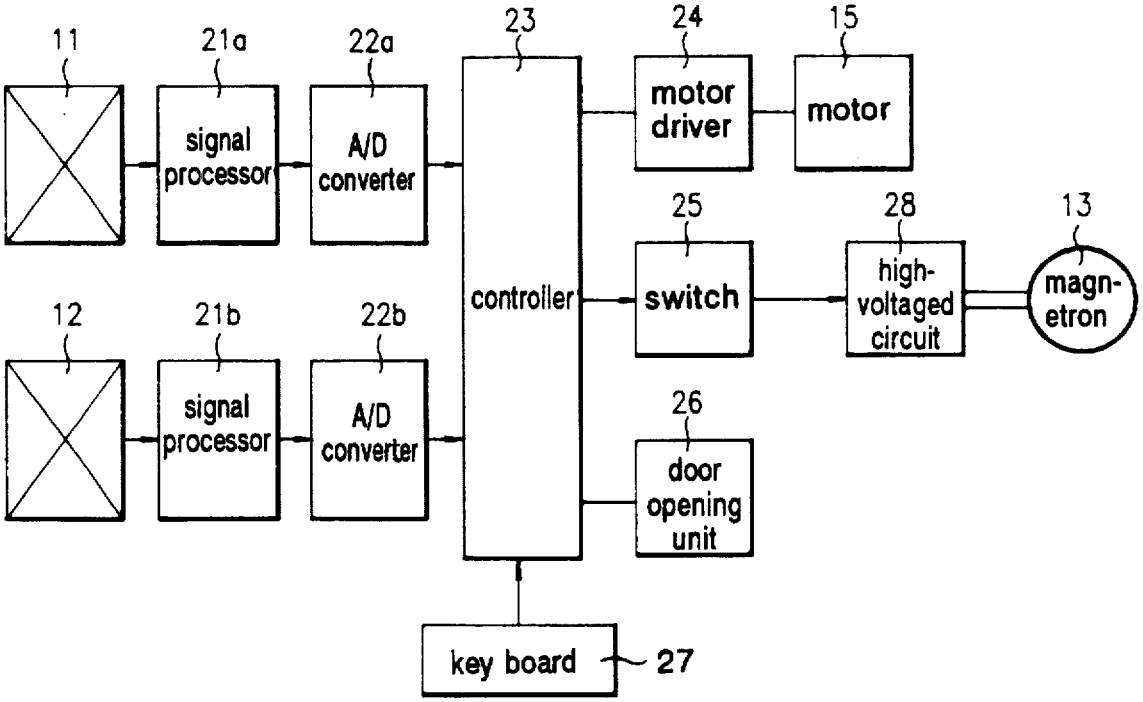
FIG. 2 is a circuit diagram of a microwave oven according to the present invention.

As shown in FIG. 2, the microwave oven according to the present invention includes first and second infrared sensors 11 and 12 for detecting heat emitted from food being boiled, signal processors **21*a* and 21*b* for obtaing a precise surface temperature of food, irrespective of the deviation of distances between each infrared sensors, using signals received from the first and second infrared sensors 11 and 12, analog-to-digital (A/D) converters 22*a* and 22*b* for converting an analog signal into a digital signal, a controller 23 for receiving the signal converted by the A/D converters 22*a* and 22*b* to then recognize the food status and controlling a motor 15 and a magnetron 13 in accordance with a cooking method, a switch 25 for turning on and off the magnetron 13 in accordance with the output signal of the controller 23, a high-voltaged circuit 28 for operating the magnetron 13 in accordance with on/off operation of the switch 25, and a key board 27** for selecting a food menu or cooking method.

Figure 1:
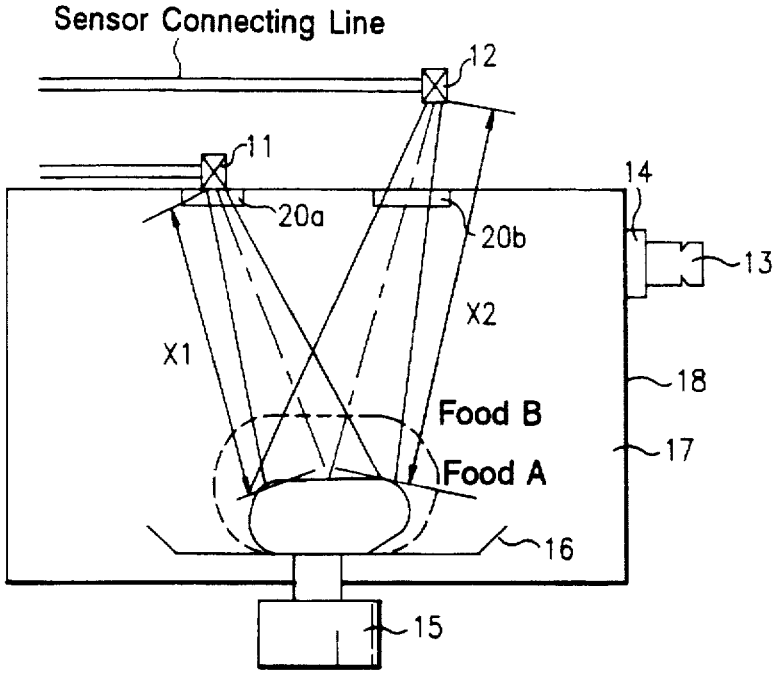
FIG. 1 shows an internal structure of a microwave oven provided with a sensor externally.

Also, as shown in FIG. 1 which shows an internal microwave oven having infrared sensors for transmitting a signal to a cooking status detecting circuit of the microwave oven fixed thereon, the first and second infrared sensors 11 and 12 are installed on an upper external wall of a main body 18. Infrared filters **20*a* and 20*b* which passes only the infrared ray emitted from the food, for preventing sensors from being contaminated by vapor are installed on an upper internal wall. Magnetron 13, wave-guide 14 and rotary motor 15** have the following configuration.

The operation and effect of the present invention will now be described in more detail with reference to the accompaying drawings.

A user places food on a rotating table 16 of the main body 18 and presses keys related to the cooking method and food menu selected through the key board 27, which is recognized by the controller 23. Then, the door open/close status is detected by a door opening unit 26. If the door is closed, the switch 25 and high-voltaged circuit 28 is controlled to oscillate the magnetron 13 for applying microwave to the food via the wave-guide 14.

As the cooking method for the food is executed in such a manner, if the infrared rays are generated from the food, the infrared rays are filtered through the infrared filters **20*a* and 20*b*** to then prevent the contamination due to vapor, etc.

The first and second infrared sensors 11 and 12 which receive the thus filtered signals transmit the signals to the signal processors **21*a* and 21*b***.

Here, the infrared sensor is manufactured using a silicon diaphram, which is disclosed in the previously applied invention (Application No. 94-5483). The basic concept of the present inventiion is that the heat emitted from food is detected by the infrared sensor and the temperature is compensated based on the fact that the radiant temperature of the surface of the food and the amount detected by the sensor is inversely proportionate to the square of the distance. The signal processors 21*a* and 21*b* amplifies each signal input through the sensors to then compensate the temperature. Thereafter, the signals are converted into digital signals by the A/D signal converters 22*a* and 22*b* to then be transmitted to the controller 23. Then, the controller 23 controls the magnetron 13 and motor 15 according to the cooking method for the food, which will now be described in detail.

Figure 3:
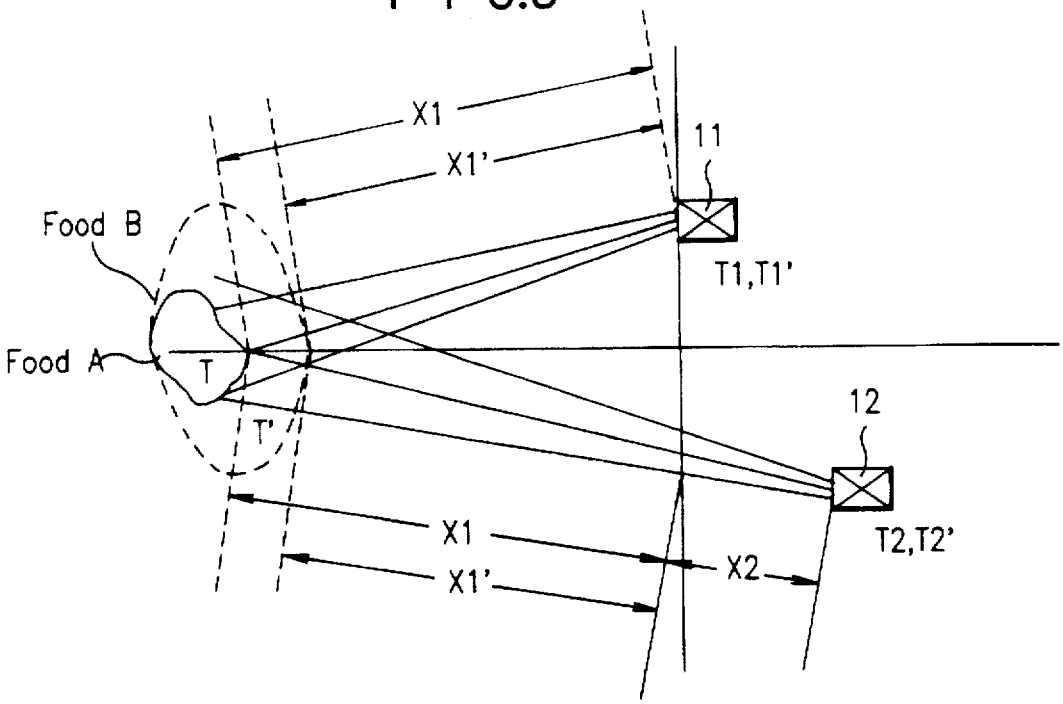
FIG. 3 is a diagram for explaining the detection of the radiant temperature of food surface.

As shown in FIGS. 1 and 3, it is assumed that the first and second infrared sensors 11 and 12 are disposed at distance intervals X1 and X2 and that the sizes of the food A and food B are different from each other. In such a condition, the method for compensating the difference will be described in the case when the distance between each food and sensor is different.

Assuming that the radiant temperature of the food surface is designated by reference letter T, the signal received from the first infrared sensor 11 is designated by T1 and the signal received from the second infrared sensor 12 is designated by T2, then, $$T1 \propto X1^2 \times T \quad (1)$$

$$T2 \propto (X1+X2)^2 \times T \quad (2)$$

where X1 is the distance between the first sensor 11 and food surface and X2 is the difference between the distances of the first sensor 11 and the second sensor 12.

Thus, if the expression (1) is applied to the expression (2), then it is obtained that $(T1\ T2) \times X1^2 + 2 \times T1 \times X2 \times X1 + X2^2 \times T1 = 0$. Then, the second degree equation with respect to X1 is solved. The obtained value of X1 is applied to the expression (1), thereby obtaining the radiant temperature of the food surface.

In other words, since the distance between the food and sensor is compensated by the answer of the second degree equation, the temperature of the food surface can be meansured irrespective of the distance.

In the same manner, the temperature of the food surface can be also obtained in the case of the food B whose distance between the sensor and food is different from that of the food A.

Here, the temperature of the food surface whose distance factor is compensated is detected by the operation using a real-time process or look-up table. The controller 23 receives signals input via A/D converters 22*a* and 22*b* in a constant period of time, calculates the radiant temperature of the food surface by the expressions (1) and (2) to then compare the calculated temperature with a reference value, and then controls the oscillation mode of the magnetron 13.

The thus obtained radiant temperature of the food surface supplies a comparatively precise cooking status, irrespective of the kind, size, shape of the food, thereby enabling to be adopted for automatic cooking of a microwave oven, in particular, cooking which is completed below the boiling point of water such as defrosting or boiling which is difficult to detect the cooking status.

Also, by using a reflection film, which has the effect to dispose two sensors at a constant distance interval, the detection error due to the shape of the food is compensated. First, as shown in FIG. 4, two sensors are disposed perpendicularly to each other and a reflection film 42 is installed on one of the two sensors, thereby setting constantly the distance between the first infrared sensor 11 and reflection film 42.

Figure 4:
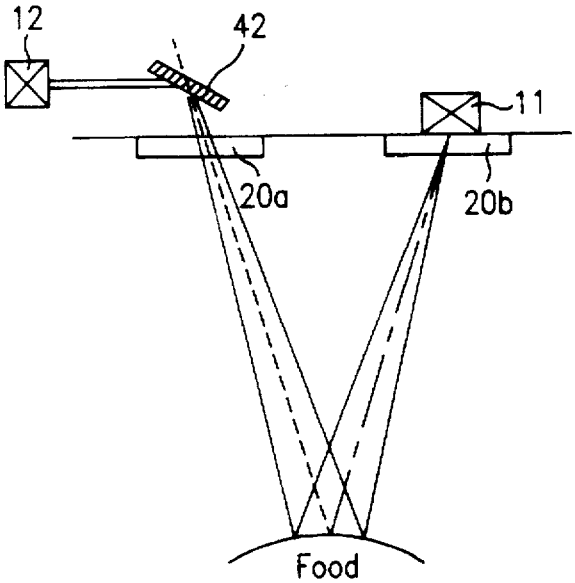
FIG. 4 is a diagram for explaining a first embodiment of the present invention.

The sensors are disposed as shown in FIG. 4 so that the choice for the position of sensors can be widened.

Figure 5:
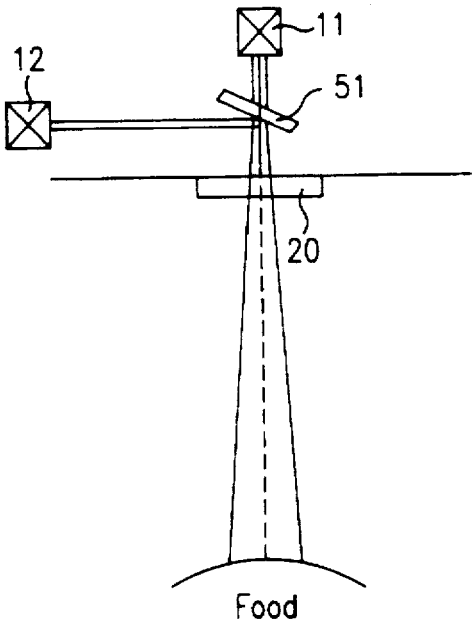
FIG. 5 is a diagram for explaining a first embodiment of the present invention.

Also, as shown in FIG. 5, by using a half reflection film 51, sensors are disposed perpendicularly to each other and reflects a half of heat rays emitted from the food and transmits a residual half of the heat rays.

Disposing sensors using a reflection film makes options in designing a module variable, and is also considered as a counterplan for a problem of a sensor contamination.

Two infrared sensors 11 and 12 are adopted in the embodiments of the present invention. However, sensors more than two can be used in another embodiment of the present invention.

As described above, conventionally, the temperature of the food is indirectly measured using a temperature sensor, wetness sensor, gas sensor or weight sensor. However, according to the present invention, the temperature of the food surface is directly measured using a plurality of infrared sensors, which enables to detect a precise cooking status. Also, using a compensating infrared sensor, the output deviation of variations in distance between the infrared sensor and food is compensated, which enables an automatically controlled cooking such as defrosting or warming.

What is claimed is:

1. A microwave oven comprising:

a microwave generator;

a cooking chamber;

a rotating table at the bottom of the cooking chamber for supporting food;

at least two infrared sensors disposed at the top of the cooking chamber above the rotating table and at different distances from the plane of the rotating table;

a signal processor for obtaining a precise temperature of the food surface using output signals of said sensors, irrespective of the deviation of distances between said sensors and food; and a controller for receiving the output signal of said signal processor to recognize the cooking status of the food and controlling the heating of the food in accordance with the recognized cooking status.

2. A microwave oven as claimed in claim 1 wherein said controller operates a predetermined second degree equation using the output signals of the respective sensors, compensates the deviation of distances between food and the respective sensors by the answer of said equation and detects the temperature of the food surface precisely.

3. A microwave oven as claimed in claim 2 wherein if two sensors are used, then the answer of the second degree equation is obtained by an equation $(T1\ T2) \times X1^2 + 2 \times T1 \times X2 \times X1 + X2^2 \times T1 = 0$, where T1 and T2 are values measured by said first and second sensors, X1 is the distance between said first sensor and second sensor and X2 is the difference in distance between said first sensor and second sensor.

4. A microwave oven as claimed in claim 1 further comprising at least one reflection film for reflecting heat rays emitted from the food to then be incident onto said sensors in order to increase options in disposing said sensors.

5. A microwave oven as claimed in claim 4, wherein said reflection film is a half reflection film for reflecting a half of heat rays emitted from the food and transmits a residual half of the heat rays.

6. The microwave oven as recited in claim 1, wherein each of the infrared sensors is a thermopile type infrared sensor.

* * * * *